US005422825A

United States Patent [19]

Lin et al.

[11] Patent Number: 5,422,825

[45] Date of Patent: Jun. 6, 1995

[54] SYSTEM FOR MONITORING AND CONTROLLING SUPERSATURATION IN AGX PRECIPITATIONS

[75] Inventors: Mitchell M. Lin; Jong S. Wey, both of Penfield, N.Y.

[73] Assignee: Eastman Kodak Company, Rochester, N.Y.

[21] Appl. No.: 108,160

[22] Filed: Aug. 17, 1993

[51] Int. Cl.[6] ..... G03C 1/005; G03C 1/015

[52] U.S. Cl. ..... 364/496; 364/497; 364/500; 364/502; 430/30; 204/406; 204/416

[58] Field of Search ..... 364/496, 497, 500, 502; 430/569, 30; 423/491; 422/68.1, 82.03; 436/43; 204/419, 406, 416

[56] References Cited

U.S. PATENT DOCUMENTS

| | | | |
|---|---|---|---|
| Re. 32,920 | 5/1989 | Matson et al. | 422/68.1 X |
| 3,791,793 | 2/1974 | Freidmann et al. | 422/62 X |
| 3,809,636 | 5/1974 | Higashiyama et al. | 204/419 |
| 3,896,020 | 7/1975 | LeBlanc, Jr. | 204/1 T |
| 3,999,048 | 12/1976 | Pathemore | 364/500 X |
| 4,172,778 | 10/1979 | van de Leest et al. | 204/419 |
| 4,263,010 | 4/1981 | Randolph | 364/500 X |
| 4,396,486 | 8/1983 | Mruk et al. | 204/419 |
| 4,506,226 | 3/1985 | Luce et al. | 324/459 |
| 4,549,953 | 10/1985 | Driscoll et al. | 204/419 |
| 4,619,739 | 10/1986 | Kanno et al. | 204/416 X |
| 4,933,870 | 6/1990 | Chang | 364/497 |
| 5,004,998 | 4/1991 | Horii | 340/507 |
| 5,202,226 | 4/1993 | Saitou | 430/569 |
| 5,238,805 | 8/1993 | Saitou | 430/569 |
| 5,248,577 | 9/1993 | Jerome | 364/500 X |

FOREIGN PATENT DOCUMENTS

| | | | |
|---|---|---|---|
| 174021 | 3/1986 | European Pat. Off. | 364/500 |
| 176794 | 4/1986 | European Pat. Off. | 364/500 |
| 2312776 | 12/1976 | France | 204/419 |
| 2621731 | 12/1976 | Germany | 204/419 |
| 2819855 | 11/1978 | Germany | 423/491 |
| 2172815 | 7/1990 | Japan | 423/491 |
| 2172816 | 7/1990 | Japan | 423/491 |
| 2172817 | 7/1990 | Japan | 423/491 |

*Primary Examiner*—Ellis B. Ramirez
*Assistant Examiner*—M. Kemper
*Attorney, Agent, or Firm*—Edward Dugas

[57] ABSTRACT

This invention is a system and associated method for monitoring and controlling independently the supersaturation and halide ion concentration, during the precipitation of a silver halide emulsion in a precipitation vessel. The introduction of a silver salt is controlled in accordance with a predetermined program, which in turn is responding to the supersaturation signal measured in the vessel by a supersaturation sensor. The sensor is comprised of a true silver ion electrode and a silver-silver halide electrode. The introduction of the halide salt is controlled in accordance with the predetermined program, which in turn is responding to the halide ion concentration signal measured in the vessel by a silver-silver halide electrode and a reference electrode.

4 Claims, 12 Drawing Sheets

SYSTEM FOR MONITORING AND CONTROLLING SUPERSATURATION IN AGX PRECIPITATIONS

CROSS-REFERENCE TO RELATED APPLICATION

The present invention is related to the subject matter of U.S. patent application Ser. No. 745,668, filed Aug. 16, 1991, entitled "Process and Apparatus for Monitoring Supersaturation" and invented by M. J. Lin and J. S. Wey, (now U.S. Pat. No. 5,317,521 issued May 31, 1994) the inventors of the present invention.

FIELD OF THE INVENTION

The present invention deals with the monitoring and control of supersaturation in silver halide precipitations wherein both silver and halide ion concentrations are selectively and independently measured and controlled using a true silver ion sensor and a halide ion sensor.

BACKGROUND OF THE INVENTION

During double-jet precipitation of AgX emulsions, the excess halide ion concentration or the silver ion concentration in the reaction vessel is often controlled to match a desired profile. This is normally done by comparing the e.m.f. (mV) signals from a "silver sensor" to a desired aim value (aim mV profile) via a process controller, which then issues control commands to correct for the deviation at any given time such that the desired profile can be maintained. U.S. Pat. No. 4,933,870 by Y. Chang teaches one such state-of-the-art control system for accomplishing the above. .Typically, the silver sensor for providing the e.m.f. signals is a coated silver electrode of the second kind: Ag/AgX. The control commands are used to regulate the rate of addition of a halide salt to the reaction vessel in order to achieve the aim mV profile. This conventional practice actually controls only the excess halide ion concentration in the reaction vessel. One of the most important parameters relating to crystal growth, the supersaturation level, is not controlled. The true driving force for crystal growth is the supersaturation level which ultimately determines the size, morphology, and the composition of the emulsion crystals. It may be defined as the ratio of the product of silver and halide ion concentrations, $(Ag^+)(X^-)$, to the equilibrium solubility product, Ksp: $S=(Ag^+)(X^-)/Ksp$. Since the supersaturation involves both the halide and silver ion concentrations, a conventional control system cannot control the supersaturation level in the reaction vessel.

An example of such deficiency is the renucleation phenomena in precipitations which is controlled under the identical mV profile based on the signals from a second-kind silver electrode. If the addition rate of silver and the matched salt reagents exceeds a critical value associated with the maximal supersaturation level, renucleation occurs under the same excess halide condition.

FIG. 1 illustrates, in functional block diagram form, a (prior art) control system 10 during double jet AgX precipitation. The system receives a set-point voltage Vx' at the+input of a summing node 12 from a predefined profile. The − input to the summing node 12 receives the output signal Vx from a halide sensor (not shown in FIG. 1) in a precipitation process 18 after it is amplified in an amplifier 20 and subtracts it from the set-point voltage Vx' to determine the difference there between. The difference is an error signal, Ex, the magnitude and sign of which is indicative of how far off the system output Vx is from the desired set-point and in what direction it is off. The error signal Ex is directed to a Vx controller 14, typically of the PID type, which outputs a delta correction signal ΔFx to a summing node 16. The summing node 16 also receives signal Fx which represents a predefined halide reagent flow rate profile to provide at its output the signal Fx+ΔFx, which signal is then inputted to the precipitation process 18. Another predefined silver reagent flow rate profile, FAg is also added to the precipitation process 18. The Vx signal may be further manipulated in the Vx controller 14 to achieve maximal control benefit such as is taught in U.S. Pat. No. 4,933,870. Since the halide sensor that provides the signal Vx responds only to the halide ion concentration, the signal ΔFx from the Vx controller 14 can only maintain the halide ion concentration $(X^-)$ in the mixing vessel to the desired level. The other critical component of the supersaturation, i.e., silver ion concentration $(Ag^+)$, is not monitored and controlled with this scheme.

Using the prior art (Vx) control scheme of FIG. 1, it is possible to prepare two emulsions under an identical Vx profile and yet end up with different final crystal size distributions, because renucleation will occur whenever the silver addition rate exceeds a maximal or critical value. When the supersaturation levels are monitored as disclosed in the following section, "Detailed Description of the Invention", the supersaturation of the precipitation process can be controlled by adjusting the silver addition rates to avoid the renucleation. In fact, the silver addition rate may be controlled at a profile which yields maximal growth rate of the crystals without renucleation. One of the benefits of the present invention is the reduction of precipitation time. Another benefit of the present invention is high supersaturation growth with a reduction in the width of crystal size distribution by minimizing the Ostwald ripening effect during crystal growth. It is well known that the morphology of AgX crystals such as the percent (100) face relative to the (111) face is strongly influenced by the supersaturation level in the reaction vessel. The control of the supersaturation level enables the preparation of the AgX emulsion with the desired morphology. Other critical process in the AgX emulsion preparation such as the incorporation of dopant, the recrystallization of a mixed-halide system, etc. are also known to be sensitive to the supersaturation level. The fact that the supersaturation level can be monitored in the precipitation vessel provides additional information concerning the precipitation process which is not available from conventional Vx monitoring. This additional information may be utilized to assess the reproducibility of a given process. For example, the supersaturation signals before the start of an unseeded precipitation indicates the degree of cleanness (or contamination by silver ions) of the reaction vessel. Small amounts of contamination cannot be detected by Vx measurement, but can cause variability in the result of nucleation leading to variations in the end product. The supersaturation information may be used to assess the identicality of precipitation processes when manufactured with different equipment. In scaling up a given precipitation process, this additional information can be used to assess whether the scaleability is achieved. Thus, the present invention is also an extremely useful diagnostic tool for the purpose of process monitoring and control, and additionally provides a clear advantage over conventional control practices.

SUMMARY OF THE INVENTION

In one preferred embodiment of the invention there is provided a system for controlling the ion concentration and supersaturation level during a silver halide precipitation process comprising:

first means for controllably introducing a silver salt into a precipitation vessel;

second means for controllably introducing a halide salt into the precipitation vessel;

a sensor comprised of ion-specific electrodes to provide signals representing the silver and halide ion concentrations during the precipitations; and controller means for receiving the provided signals and for controlling said first and said second means to maintain the supersaturation and halide ion concentration levels according to predetermined profiles.

In another preferred embodiment of the invention there is provided a method for controlling the ion concentration and supersaturation level during a silver halide precipitation process comprising the steps of:

a) measuring the amount of halide ion in a precipitation vessel to provide a Vx signal;

b) measuring the amount of silver ion in the precipitation vessel to provide a Vs signal; and c) controlling the amount of silver and halide reagent added to the precipitation vessel to maintain a predetermined Vx and Vs profile.

The system and method of the present invention provides concurrent measurements and control of the supersaturation and halide ion concentration during a silver halide emulsion precipitation process.

From the foregoing it can be seen that it is a primary object of the present invention to provide an improved system for controlling supersaturation in AgX precipitations.

It is another object of the present invention to provide a system that will monitor and control more than one ionic species in a reaction system.

These and other objects of the present invention will become more apparent when taken in conjunction with the following description and drawings wherein like characters indicate like parts and which drawings form a part of the present specification.

DETAILED DESCRIPTION OF THE INVENTION

During the precipitation when the product of silver ion and halide ion concentration must be greater than the equilibrium Ksp in order for the crystals to sustain growth (reference: U.S. patent application Ser. No. 745,668 now U.S. Pat. No. 5,317,521 cited above). A second-kind electrode (Ag/AgX) is known to respond to the halide ion concentration through an AgX equilibrium solubility product relationship. The present invention utilizes a "true" silver electrode such as a "bare" Ag electrode of the first-kind (or a $Ag_2S$ solid-state, ion selective electrode, e.g., ORION 94-16) to monitor the silver ion concentration. Therefore, the supersaturation level in the reaction vessel during AgX precipitations can be obtained offering the capability of additional degrees of control. The supersaturation signals (Vs) from the "bare" silver electrode and the second-kind electrode can be used to monitor and control the supersaturation level during AgX precipitations in addition to the conventional Vx control.

Figure 2:
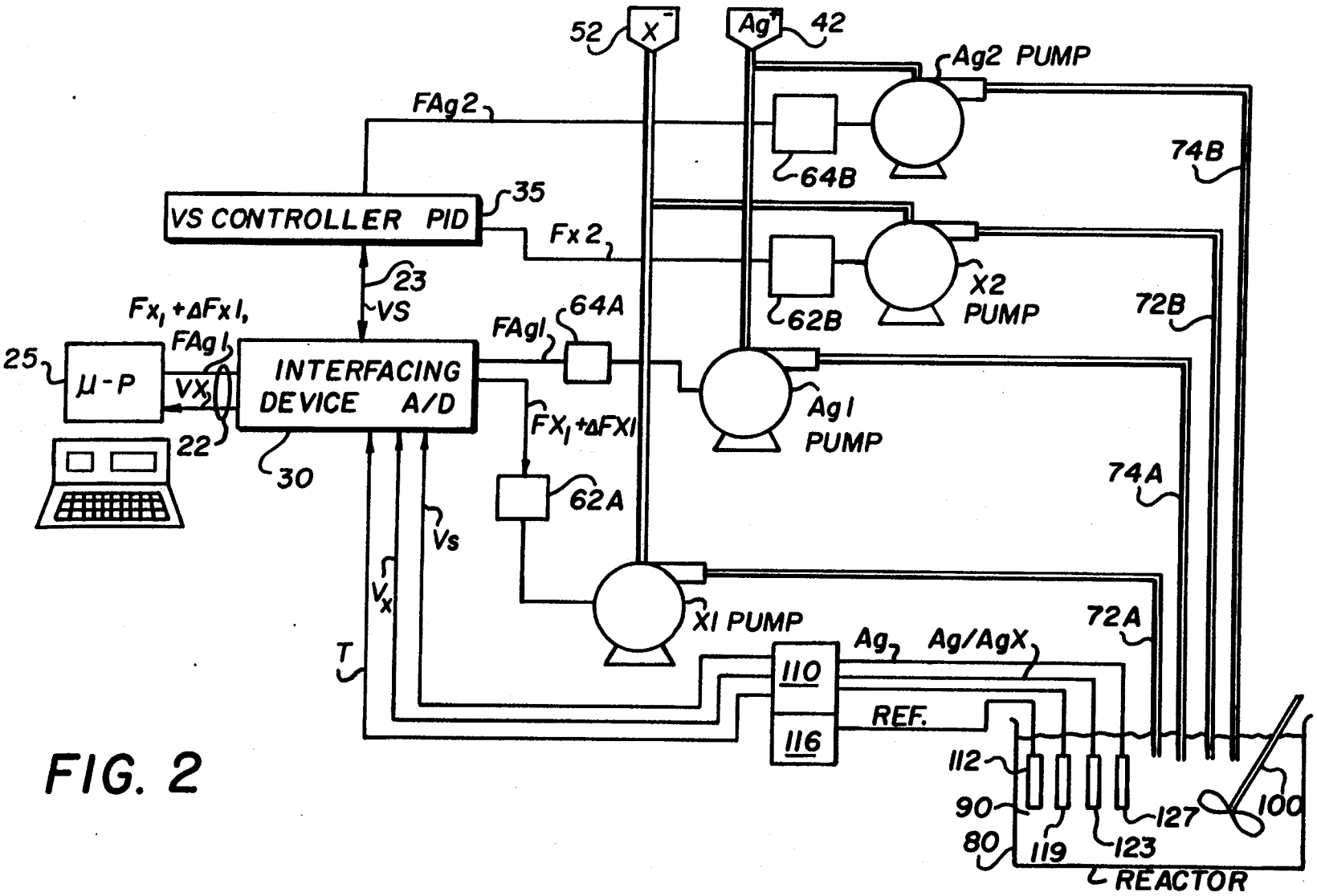
FIG. 2 is a block schematic diagram of the improved control system of the present invention.

FIG. 2 illustrates a preferred system arrangement utilizing a "cascaded" control scheme where both Vx and Vs are controlled with respect to their own setpoint profiles simultaneously. A precipitation vessel 80 holds an emulsion 90 which is agitated by a mixer 100. An aqueous halide salt solution, from a storage vessel 52 is pumped into the precipitation vessel 80 through piping 72A and 72B by means of pumps X1 and X2, respectively. The pumps X1 and X2 respond to power signals from pump drivers 62A and 62B, respectively. In a like manner, a silver nitrate solution, from a storage vessel 42 is pumped into the precipitation vessel 80 through piping 74A and 74B by means of pumps Ag1 and Ag2, respectively. The pumps Ag1 and Ag2 respond to power signals from pump drivers 64A and 64B, respectively. Submerged in the emulsion 90 is a temperature probe 112, a reference electrode 119, a second-kind electrode 123, and a first-kind electrode 127. In the preferred embodiment of the invention the temperature probe 112 is a Hycal Engineering, RTS series probe. The first-kind electrode 127 may be composed of a bare silver electrode or the Orion Model 94-16. The second-kind electrode 123 may be of the silver-silver halide type. The reference electrode 119 can be of the commercially available silver-silver chloride type, for example, Corning model 476,340.

The temperature probe 112 is coupled to an interfacing device 30 by means of a temperature transmitter 116. The temperature transmitter is of the type manufactured by Hycal Engineering, bearing their model number CT-801A. The electrodes 119, 123 and 127 define a Vs and Vx sensor assembly. The sensor assembly (electrodes 119, 123, and 127) is coupled to the interfacing device 30 by means of a buffer circuit 110 to generate the voltage signals Vx and Vs from the electrodes to a level corresponding to the input response range of the interfacing device 30.

Figure 3:
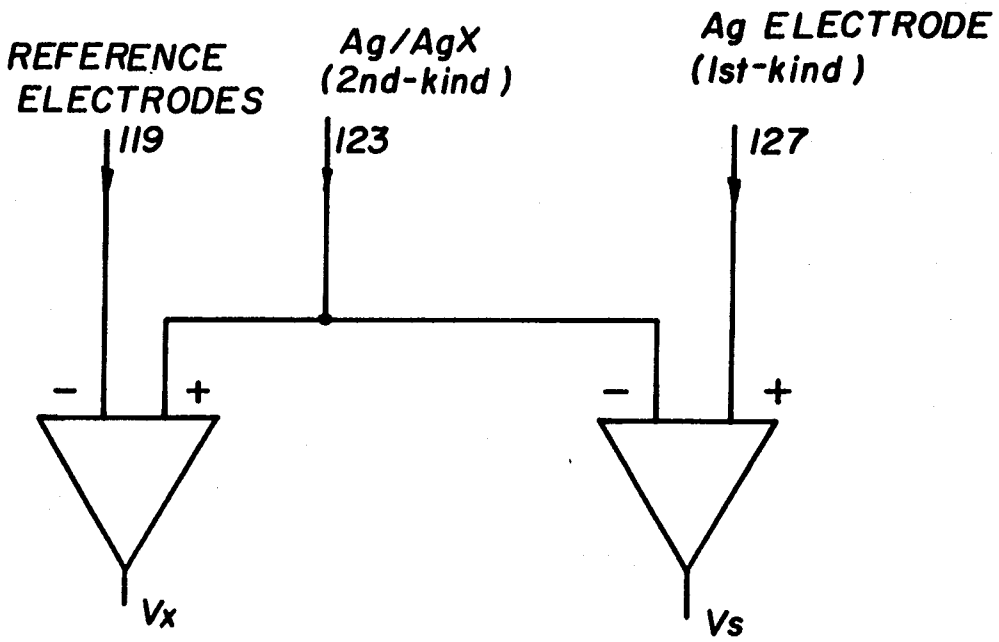
FIG. 3 is a block schematic diagram of a buffer circuit used in the embodiment of FIG. 2.

A typical buffering circuit 110 for the Vx and Vs sensor is shown in FIG. 3 comprised of a pair of comparitors for extracting the difference between the signal level from the electrode 123 and the signals from the electrodes 119 and 127. The interfacing device 30 functions to transform the analog voltages received from the buffer 110 and the temperature transmitter 116 into corresponding digital signals. The corresponding digital signals are then provided to a computer 25 via a bi-directional data bus 22. The computer 25 operates on the provided Vx signal and compares this signal with the predefined set-point Vx' to generate the control signal ΔFX1 and to combine it with a predefined halide flow rate signal FX1. The combined signal FX1+ΔFX1 (node 16 in FIG. 1) is transmitted via the data bus 22 and the interfacing device 30 to the pump driver 62A to drive the pump X1. The computer 25 also provides the silver flow rate signal FAg through the interfacing device 30 to the pump driver 64A to drive the pump Ag1. In the preferred embodiment of the invention the interfacing device 30 is an I/O board supplied by Burr-Brown under their Model No. PCI-20001 for the carrier, Model No. PCI-20002M for the A/D converter, and PCI-200021M for the D/A converter. The computer 25 is an IBM PC or compatible.

In this invention, the silver reagent flow rate FAg1 is further adjusted according to the Vs error signals in the Vs controller 35. The Vs controller 35 is connected to the interfacing device 30 via a bus 23. The Vs controller compares the measured Vs signal from interfacing device 30 to the set-point Vs' to generate control signal FAg2 for driving pump Ag2 via the pump driver 64B. The Vs controller 35 may be of the conventional PID type such as the Honeywell Electr-O-Volt. The Vs signals may be further manipulated such as taught in U.S. Pat. No. 4,933,870. In FIG. 2, there is a "feed-forward" term FX2 generated in the Vs controller, which may be of equal molar addition rate to the term FAg2 generated by the Vs controller. This is added in addition to the "feed-back" term ΔFX1 which is generated from the Vx controller to assist the Vx control effort. The signal FX2 is sent from the Vs controller 35 to driver 62B for controlling the pump X2. Thus, the desired supersaturation level, as measured from Vs signals, can be controlled during AgX precipitations where the halide ion concentration level is also controlled.

Figure 1:
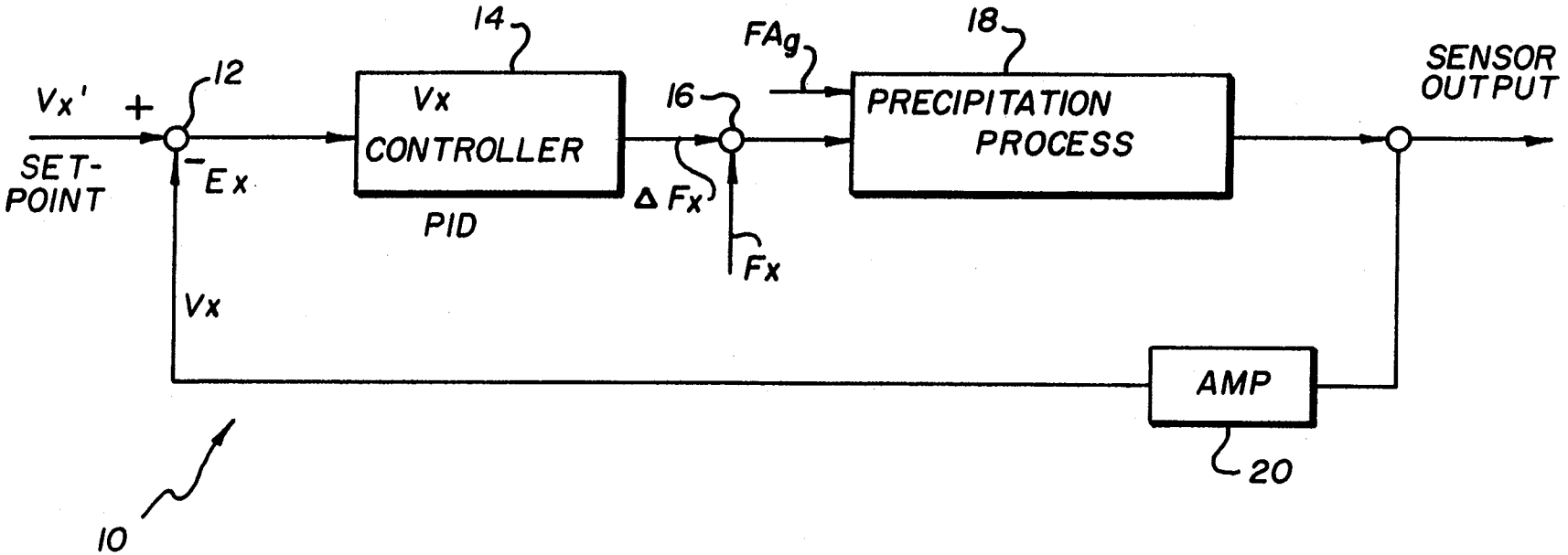
(PRIOR ART) FIG. 1
FIG. 1 is a functional block schematic diagram of a (prior art) control system.

Computer 25, connected to interface 30, corresponds in functionality t, the node 12, Vx controller 14, and node 16 in FIG. 1. The precipitation process function box 18 of FIG. 1 corresponds to the vessel 80, emulsion mix 90, mixer 100, sensors 112, 119, 123 and 127 in FIG. 2. The amplifier box 20 in FIG. 1 is represented by boxes 110 and 116 in FIG. 2. The additional elements shown in FIG. 2 implement the improvements of the present invention. Although not shown, various modifications may be made to the best mode implementation shown in FIG. 2, e.g., the Vs controller 35 can be integrated into the computer 25 by means of software or firmware, thereby eliminating the need for pump drivers 62B, 64B and their corresponding pumps X2 and Ag2, respectively.

Figure 4A:
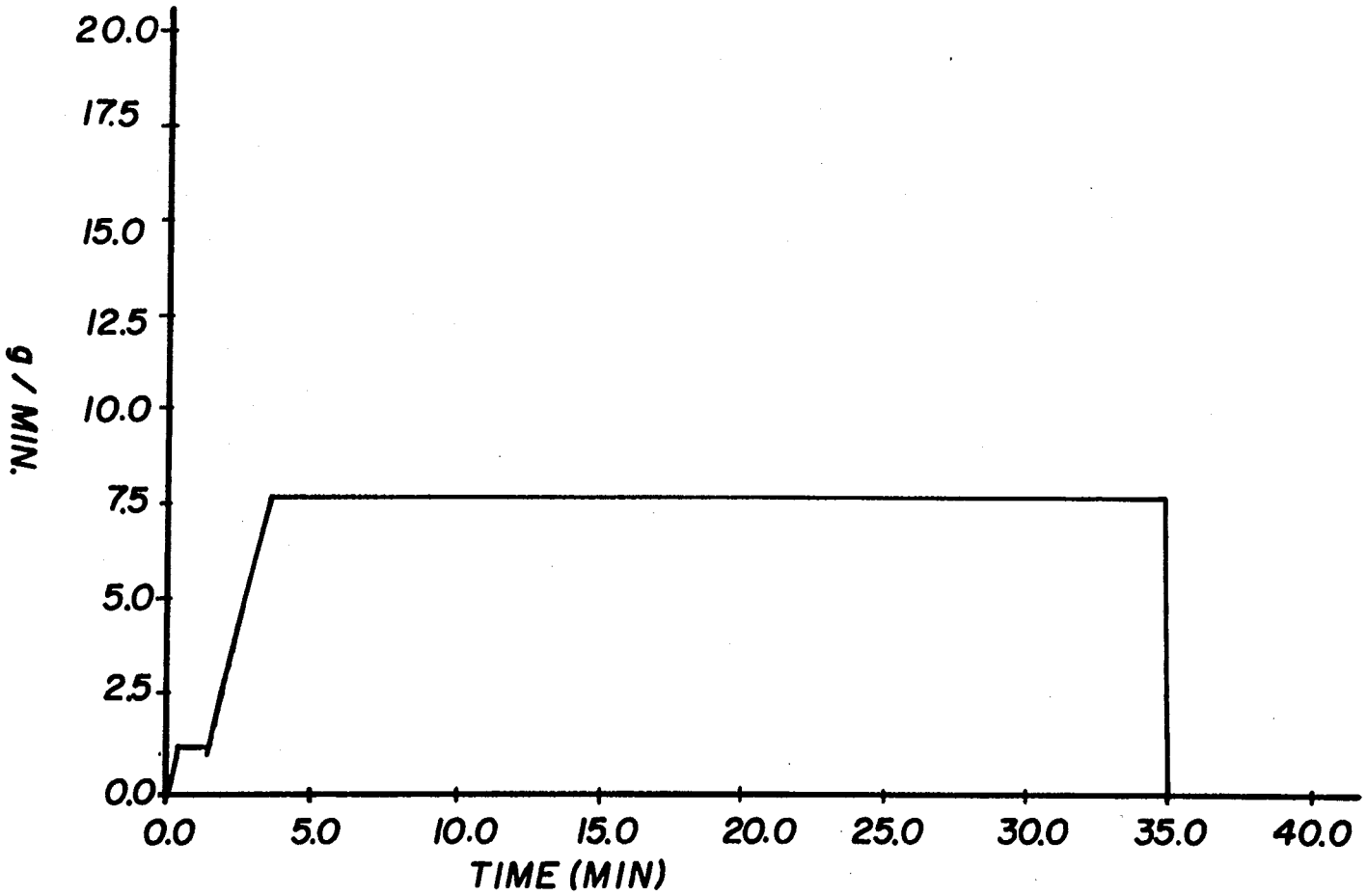
FIGS. 4A and 4B illustrate in chart form the silver reagent addition rate and the associated crystal size distribution of a conventional Vx control scheme
Figure 4B:
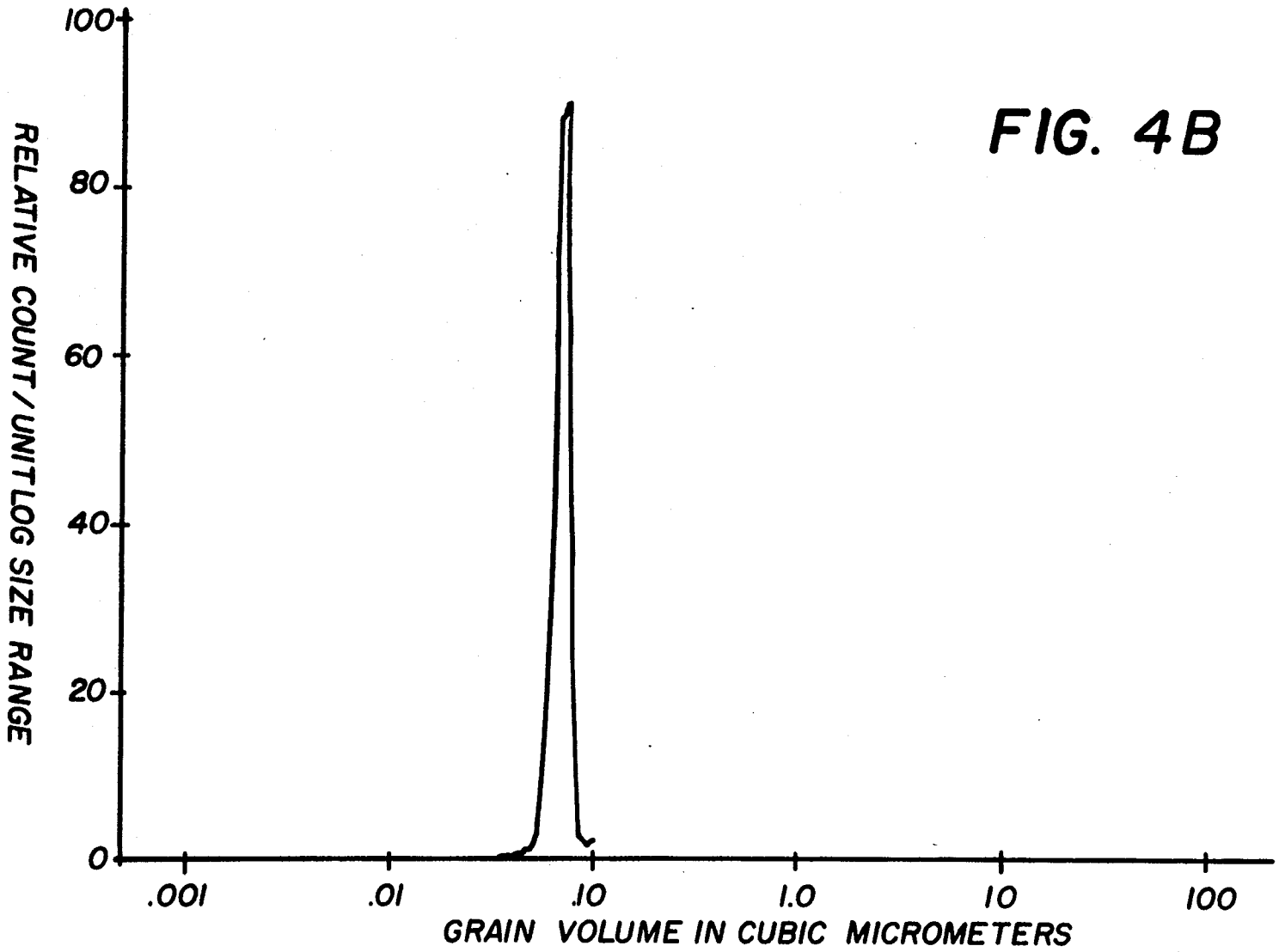

FIG. 4A, illustrates an addition profile of 1.0M silver reagent to a vessel that is 4 liters in volume containing 0.189 mole of silver bromide cubic seed crystals of edge length 0.33 microns suspended in a 2 wt % gelatin solution. The temperature of the emulsion mixture is kept at 70° C. and the pH at 5.7. The pAg was controlled at 7.18 by a conventional Vx controller of the type referenced in FIG. 1. The emulsion was grown into a 0.41 micron cube without renucleation and the run time was 35 min. FIG. 4B shows the histogram of the crystal volume distribution at the end of the precipitation process. Note that only mono-modal distribution is observed.

Figure 5A:
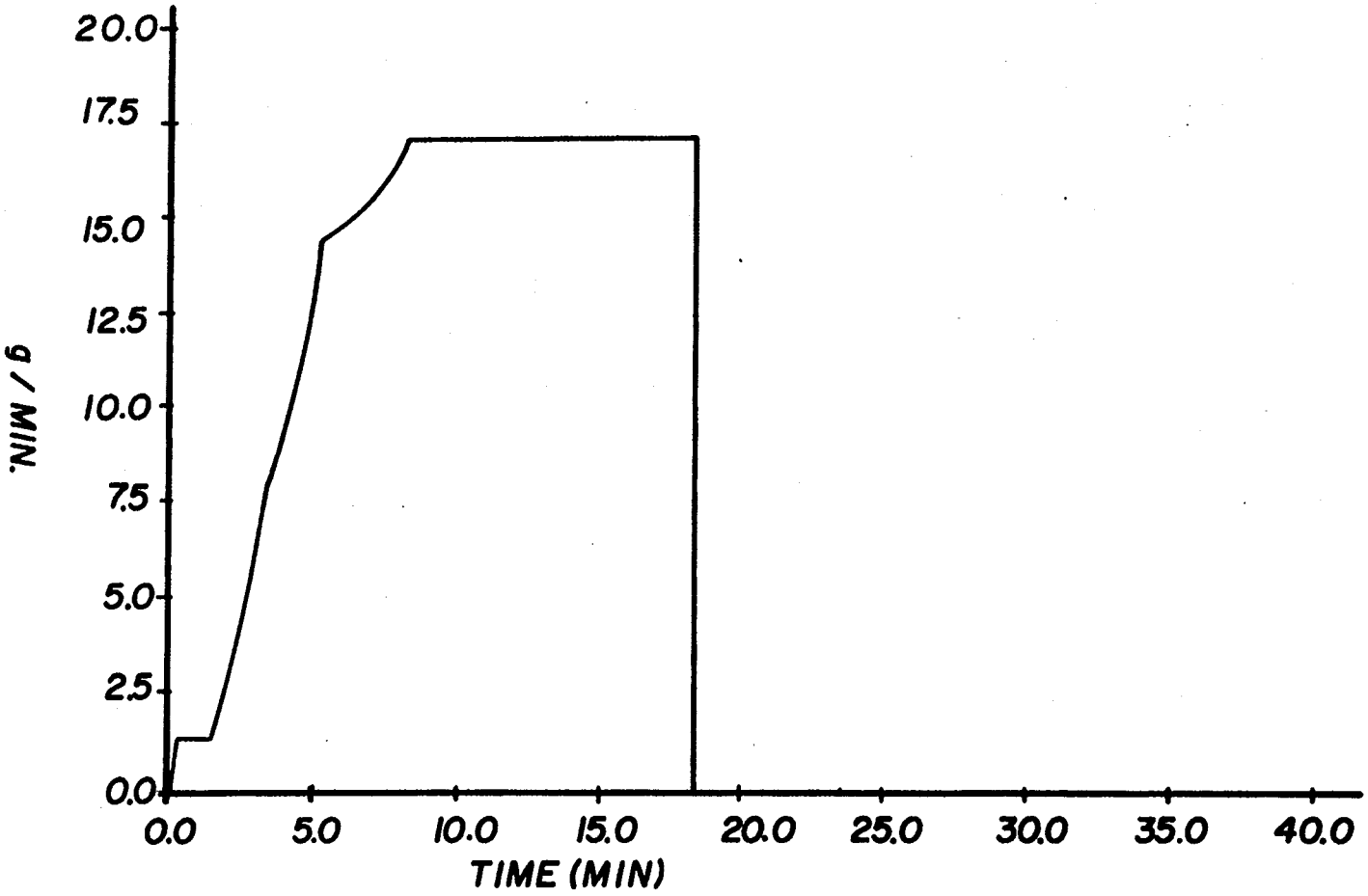
FIGS. 5A and 5B illustrate in chart form the silver reagent addition rate and the associated crystal size distribution of a conventional Vx control scheme where an increase in silver reagent addition rate resulted in renucleation.
Figure 5B:
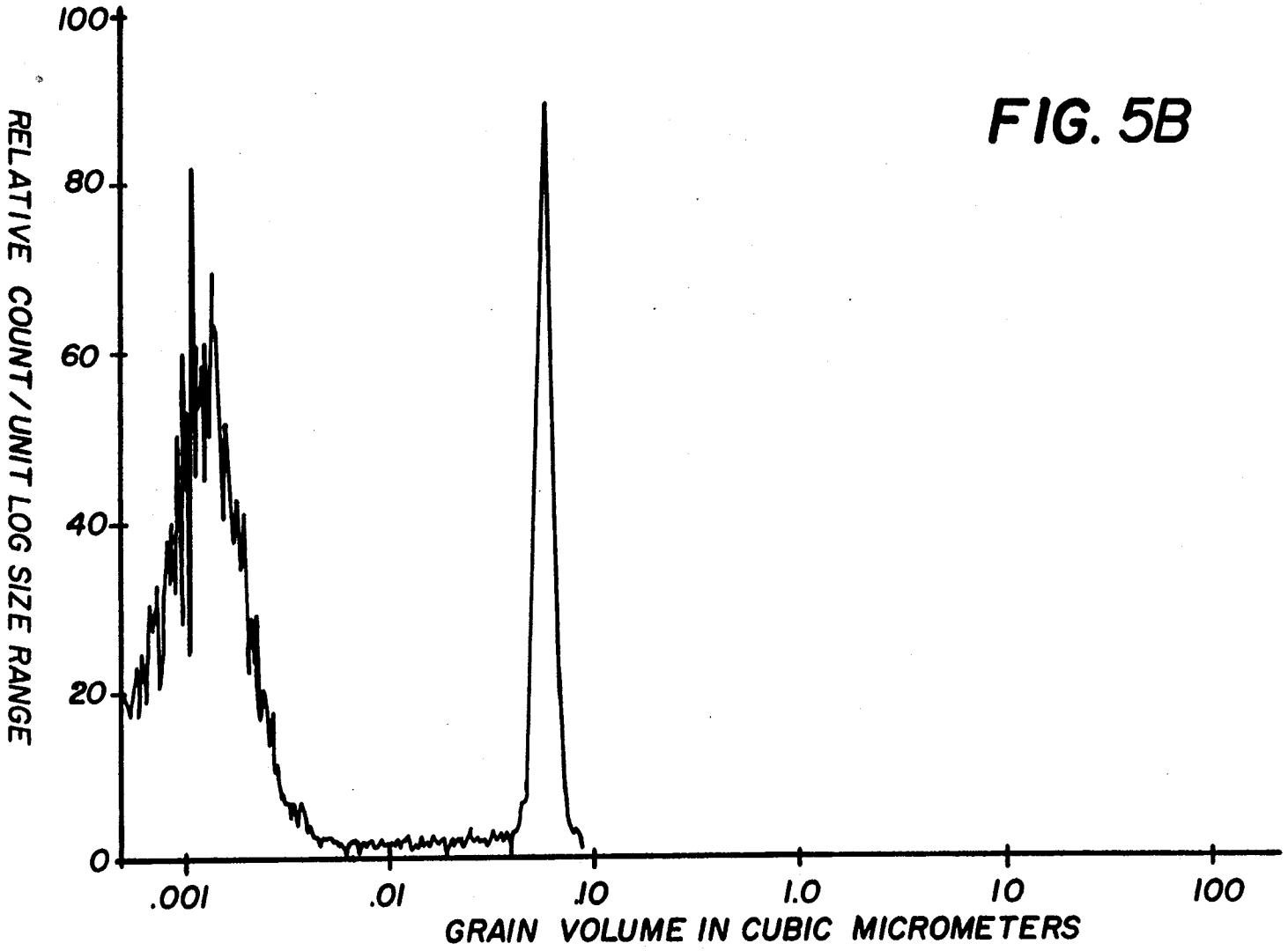

In FIG. 5A the silver addition rate was increased in an attempt to shorten the run time to achieve the same size increase to the seed crystal. Although the pAg was controlled in the same manner by Vx control, the crystal renucleated. In FIG. 5B, the histogram of crystal volume distribution at the end of the precipitation clearly shows the renuclei (fine-grain) population.

Figure 6A:
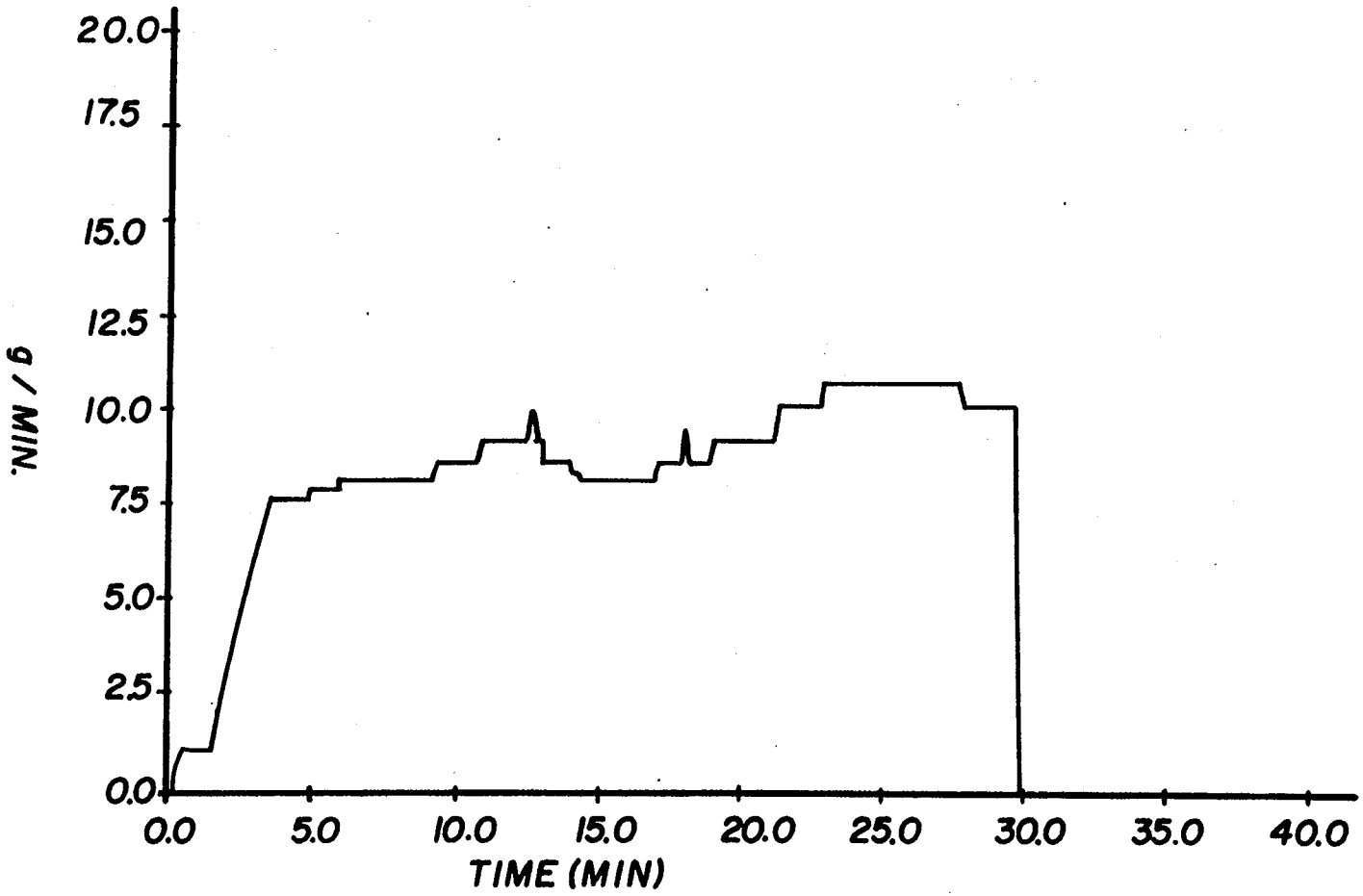
FIGS. 6A and 6B illustrate in chart form the silver reagent addition rate and the associated crystal size distribution according to the scheme of the present invention where a moderate increase in silver reagent addition rate resulted in a shorter run time without renucleation.
Figure 6B:
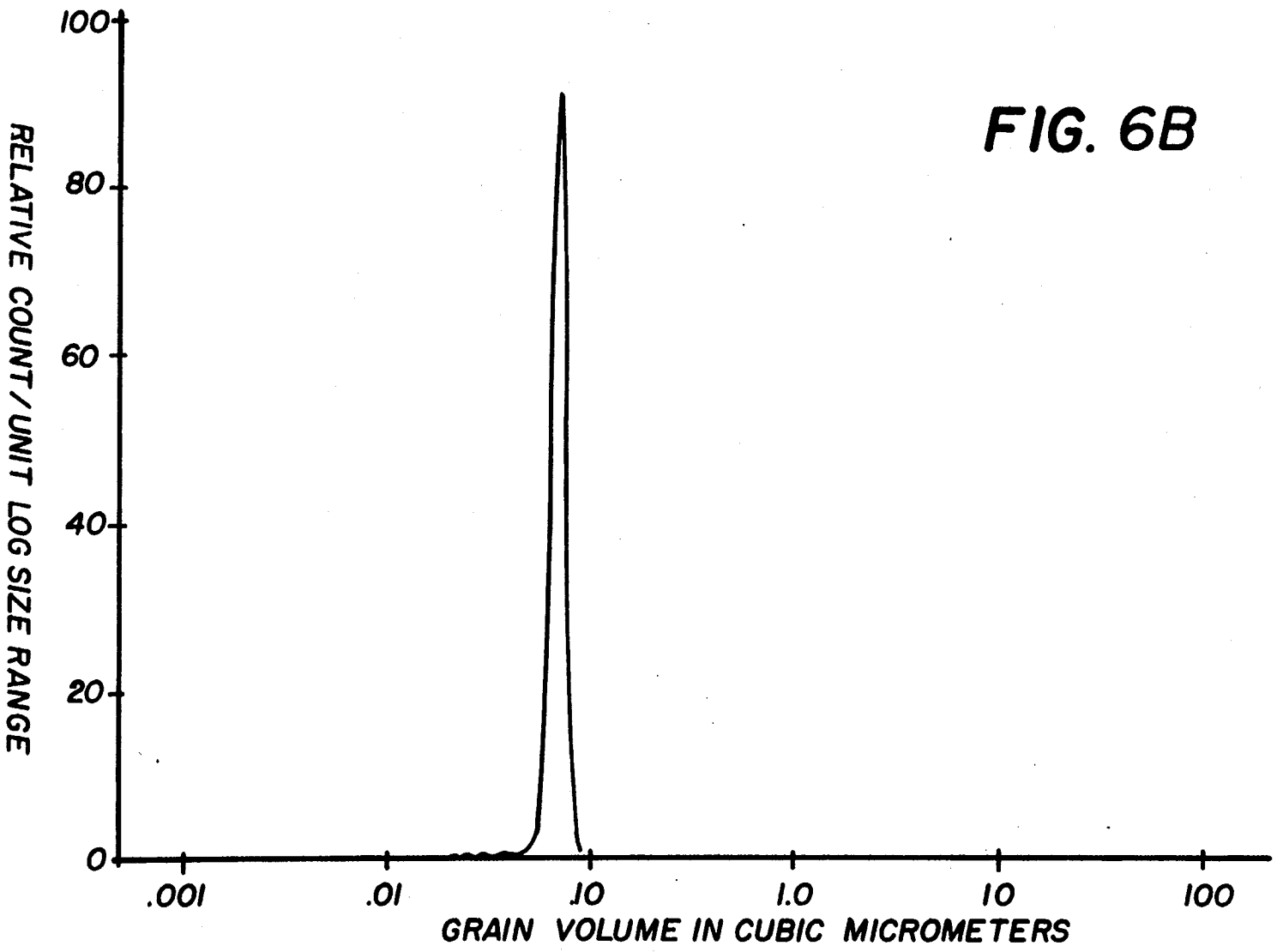

Referring to FIG. 6A, the Vs controller of this invention was implemented such that Vs was controlled at 6 mV. The run time was reduced to 30 min without renucleation (see FIG. 6B).

Figure 7A:
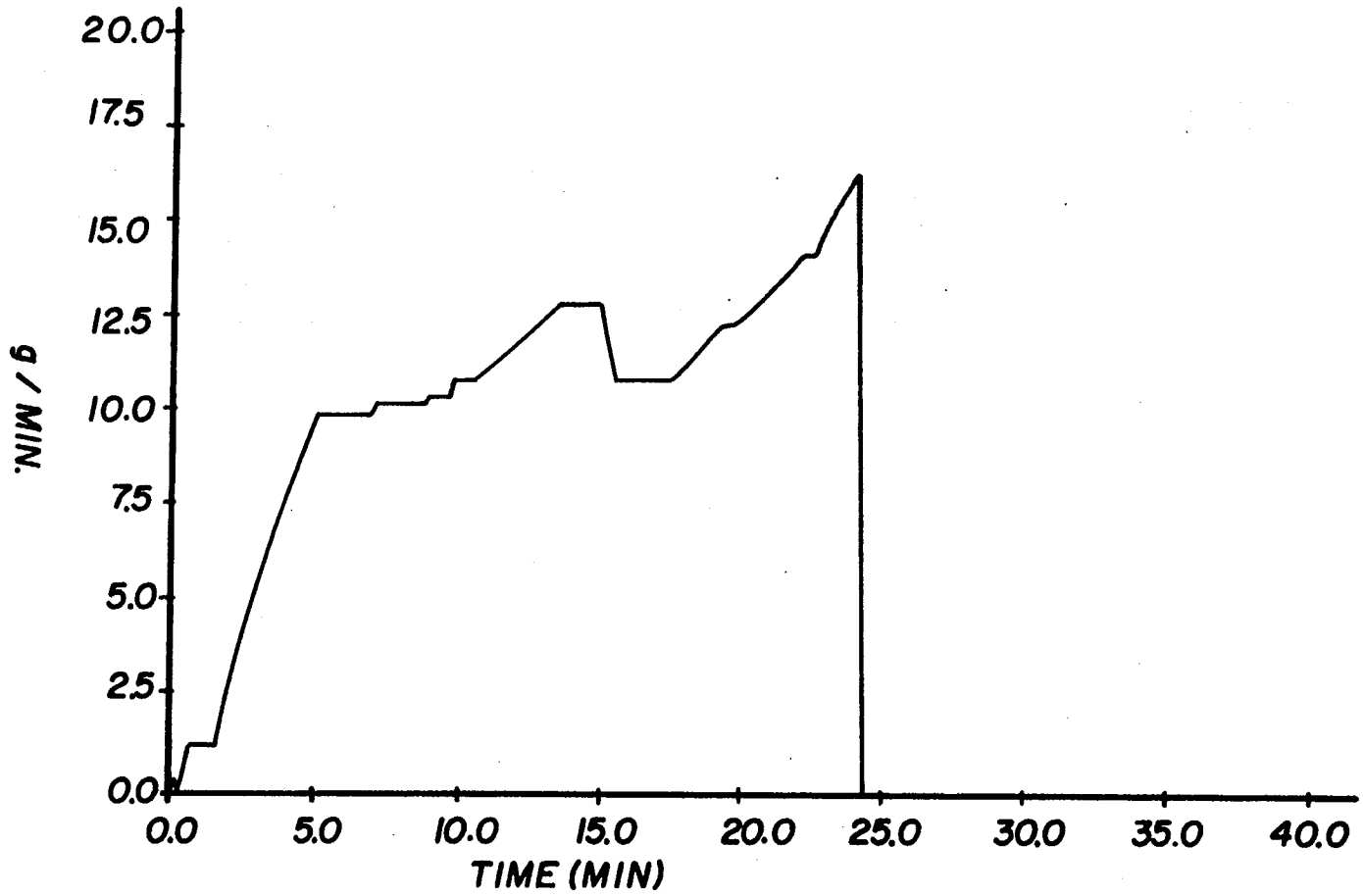
FIGS. 7A and 7B illustrate in chart form the silver reagent addition rate and the associated crystal size distribution according to the scheme of the present invention where a large increase in silver reagent addition rate resulted in an even shorter run time without renucleation.
Figure 7B:
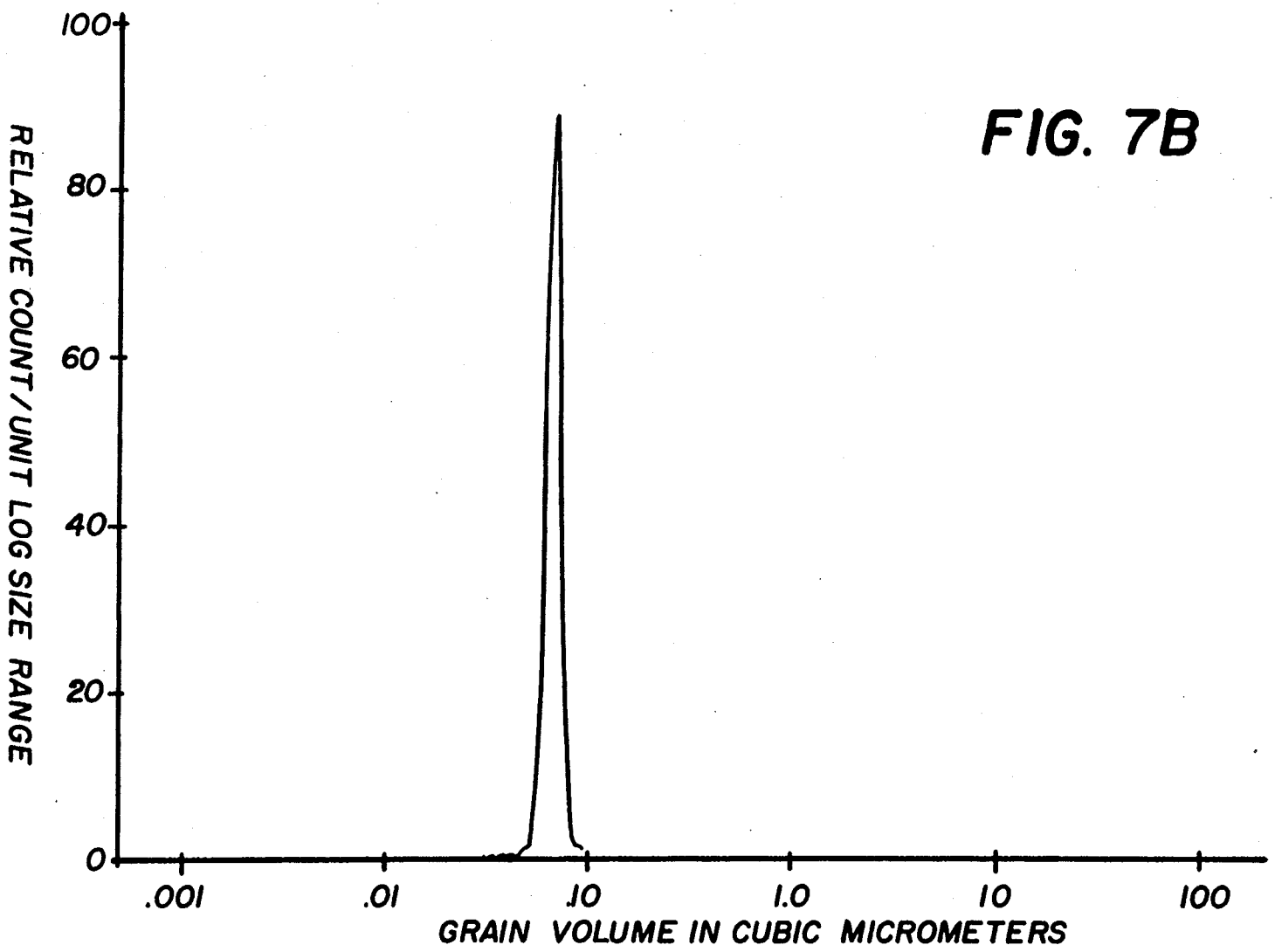

Referring to FIG. 7A, the Vs controller of this invention was implemented such that Vs was controlled at 8 mV, a higher supersaturation level. The run time was further reduced to 24 min without renucleation, see FIG. 7B.

Any fluctuations in the silver addition rate profile in FIGS. 6A and 7A are a result of controller action which was not optimized at the time of filing this application.

Figure 8:
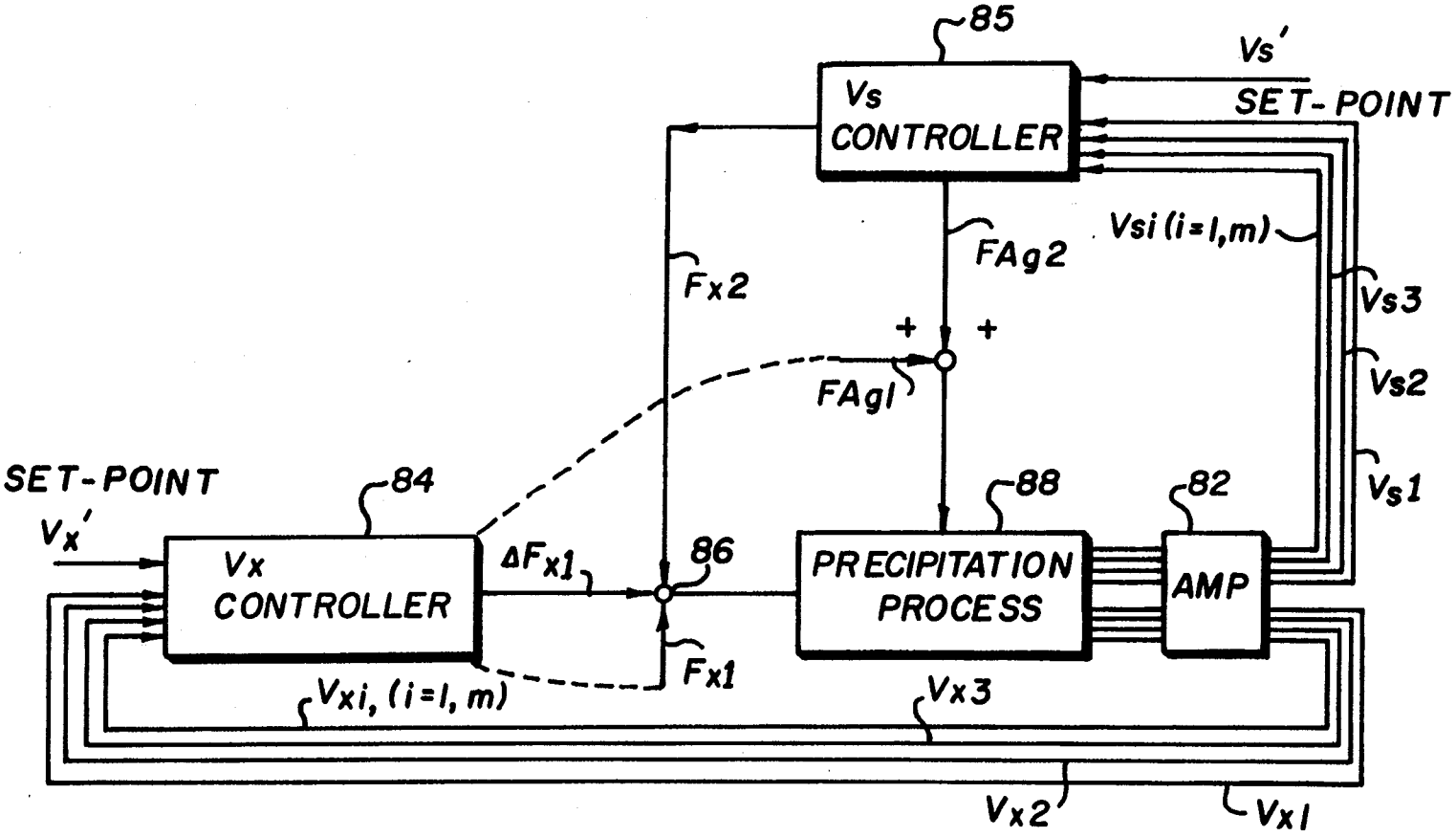
FIG. 8 illustrates in functional block diagram form an improved control system incorporating multiple-sensors.

It is to be understood that the reaction vessel mix may not be homogeneous with respect to the halide ion concentration or the supersaturation level during AgX precipitation. To obtain more representative readings and control this invention further discloses the use of multiple sensors to control supersaturation and Vx during AgX precipitation. True silver ion sensing electrodes such as bare silver electrodes or Ag/Ag2S electrodes may be positioned at selective locations inside the reaction vessel to feed the supersaturation information at each selected location. These multiple Vx and Vs signals are fed to the Vx and Vs controllers where they are processed in order to generate optimal control actions. A multiple-sensor embodiment of the invention is shown in the functional block diagram of FIG. 8. The Vx controller 84 and the Vs controller 85 functionally correspond to the computer 25 and Vs controller 35 of FIG. 2. The amplifier 82 is a multi-channel version of the corresponding buffer 110 of FIG. 2. The summing mode 86 receives the ΔFX1, FX1 and the output FX2 from the VS controller 85. The precipitation process 88 corresponds to the precipitation process of FIG. 2.

While there has been shown what are considered to be the preferred embodiments of the invention, it will be manifest that many changes and modifications may be made therein without departing from the essential spirit of the invention. It is intended, therefore, in the annexed claims, to cover all such changes and modifications as may fall within the true scope of the invention.

Parts List:

10 Control system
12 Summing node
14 Controller
16 Summing node
18 Precipitation process function box
20 Amplifier
22 Data bus
23 Bus
25 Computer
30 Interfacing device
35 Controller
42 Storage vessel
52 Storage vessel 62A Pump driver
62B Pump driver
64A Pump driver
64B Pump driver
72A Piping
72B Piping
74A Piping
74B Piping
80 Vessel
82 Amplifier
84 Controller
85 Controller
86 Summing node
88 Precipitation process
Parts List Cont'd
90 Emulsion
100 Mixer
110 Buffer
112 Temperature probe
116 Temperature transmitter
119 Electrode
123 Electrode
127 Electrode
Ag1 Pump
Ag2 Pump
X1 Pump
X2 Pump

We claim:

1. A system for controlling the ion concentrations and supersaturation level during a silver halide precipitation process comprising:

first means for controllably introducing a silver salt into a precipitation vessel;

second means for controllably introducing a halide salt into the precipitation vessel;

a sensor including a reference electrode, a metal-metal ion specific electrode, and a metal coated with a metal salt ion specific electrode, wherein the reference electrode generates a reference signal, the metal-metal ion specific electrode generates a first signal representative of silver ion concentration during the precipitation process, and the metal coated with a metal salt ion specific electrode generates a second signal representative of halide ion concentration during the precipitation process;

means for generating a halide ion concentration signal as a function of the difference between the reference signal generated by the reference electrode and the second signal generated by the metal coated with a metal salt ion specific electrode;

means for generating a supersaturation level signal as a function of the difference between the first signal generated by the metal-metal ion specific electrode and the second signal generated by the metal coated with a metal salt ion specific electrode; and controller means for receiving the halide ion concentration signal and the supersaturation level signal and for controlling said first and second means to maintain the supersaturation and halide ion concentration levels, respectively, according to a predetermined supersaturation level and a halide ion concentration profile, respectively.

2. The system according to claim 1, further comprising a temperature electrode for providing a a temperature signal to said controller means.

3. A method for controlling the ion concentration and supersaturation level during a silver halide precipitation process comprising the steps of:

a) measuring the amount of halide ion in a precipitation vessel and generating a halide ion concentration signal Vx;

b) measuring the amount of silver ion in the precipitation vessel and generating a supersaturation level signal Vs; and c) controlling the amount of silver and halide reagent added to the precipitation vessel to maintain a predetermined halide ion concentration and a supersaturation level profile.

4. A method for controlling the ion concentration and supersaturation level during a silver halide precipitation process comprising the steps of:

a) measuring the amount of halide ion in a precipitation vessel and generating a halide ion concentration signal Vx;

b) measuring the amount of silver ion in the precipitation vessel and generating a supersaturation level signal Vs;

c) determining the difference between the halide ion concentration signal Vx and a first set-point value;

d) determining the difference between the supersaturation level signal Vs and a second set-point value; and e) controlling the amount of silver and halide reagent added to the precipitation vessel to maintain the determined difference of step c and of step d at a minimum.

* * * * *